US006141941A

United States Patent [19]

Carroll

[11] Patent Number: 6,141,941

[45] Date of Patent: Nov. 7, 2000

[54] APPARATUS AND METHOD FOR INSERTING OBJECTS INTO BALLOONS

[76] Inventor: William Gregory Carroll, 2212 SW. Temple #5, Salt Lake City, Utah 84115

[21] Appl. No.: 09/268,058

[22] Filed: Mar. 15, 1999

[51] Int. Cl.[7] ..... B65B 31/00

[52] U.S. Cl. ..... 53/434; 53/512; 53/385.1

[58] Field of Search ..... 53/512, 434, 403, 53/390, 385.1, 459, 570, 138.3, 139.1, 86

[56] References Cited

U.S. PATENT DOCUMENTS

| | | | |
|---|---|---|---|
| D. 325,586 | 4/1992 | Carrol et al. . | |
| 3,455,348 | 7/1969 | Stingele et al. | 141/65 |
| 4,809,484 | 3/1989 | Lovik | 53/434 |
| 4,878,335 | 11/1989 | Hardy | 53/434 |
| 4,924,919 | 5/1990 | Oyler | 141/10 |
| 4,974,393 | 12/1990 | Rich et al. . | |
| 5,033,256 | 7/1991 | Rupp | 53/570 |
| 5,054,273 | 10/1991 | Schmitt | 53/564 |
| 5,088,267 | 2/1992 | Gee | 53/86 |
| 5,205,109 | 4/1993 | Conway | 53/403 |
| 5,322,101 | 6/1994 | Scherr et al. | 141/313 |
| 5,337,540 | 8/1994 | Carroll | 53/459 |
| 5,477,664 | 12/1995 | Carroll | 53/570 |
| 5,564,260 | 10/1996 | West et al. | 53/434 |
| 5,653,272 | 8/1997 | McCaul | 141/314 |

*Primary Examiner*—Peter Vo
*Assistant Examiner*—Christopher R. Harmon
*Attorney, Agent, or Firm*—Brian C. Trask

[57] ABSTRACT

A device to inflate a balloon and maintain it in an inflated state while providing access to the expanded balloon orifice for purpose of inserting objects. The device has a transparent, cylindrical, balloon chamber covered by a vertically movable lid having a balloon orifice expanding mechanism consisting of multiple, cam actuated, retracting fingers. Lid support columns also function as air supply ducts and have stops to hold the lid at convenient elevations for insertion of deflated balloons and removal of inflated balloons containing objects. A preferred embodiment applies positive pressure to inflate the balloon, although vacuum applied exterior to the balloon is also workable.

18 Claims, 4 Drawing Sheets

APPARATUS AND METHOD FOR INSERTING OBJECTS INTO BALLOONS

BACKGROUND OF THE INVENTION

1. Field

This invention relates to apparatus and methods for inserting objects into balloons. One embodiment of apparatus of the instant invention inflates a balloon within a chamber by the application of positive pressure internal to the balloon, and then maintains the balloon in an inflated state while the user places one or more objects into the balloon.

2. State of the Art

The ability to insert large objects into balloons provides a novel wrapping method for gift giving. Balloon wrapped objects have a unique appeal in-part because they present the "ship in a bottle" aura or mystique. The tied-off neck of a balloon suggests the small neck of a bottle, and both are seemingly too small to allow passage of the corresponding inserted object. It piques the curiosity of a recipient to see a large object inside a balloon, where the balloon orifice is so much smaller.

An early device for inserting objects into balloons used positive pressure to inflate the balloon. An object to be inserted into a balloon was placed into a box which had a large cylindrical orifice over which a balloon could be stretched. After pressurizing the balloon, the object was maneuvered into the balloon, which could then be tied closed. A rubber sleeve attachment allowed the user to manipulate the object while maintaining pressure inside the balloon. However, this device suffered from various drawbacks including controlling air leakage through the sleeve and box, as well as stretching the balloon over the cylindrical orifice without causing damage to the balloon. Additionally, the balloon was exposed during the process, potentially placing a user's face at risk from bursting balloons while manipulating objects or tieing off balloons.

A subsequent device, disclosed in U.S. Pat. No. 4,974,393, solved many of the difficulties of the earlier art. This new device avoids disadvantages of pressurized systems and operates by inflating the balloon inside a chamber through use of an applied vacuum pressure exterior the balloon. Leak-prone sleeves or air sealing devices are explicitly avoided exterior the balloon orifice during balloon inflation and the insertion of an object. Also, the balloon is located inside a chamber, thereby reducing likelihood of injury should the balloon burst during inflation or due to damage caused by the inserted object. Furthermore, balloon orifice stretching is greatly simplified by a multi-fingered, cam actuated, balloon stretching mechanism. However, difficulties remain with this disclosed design. For instance, excessively applied vacuum pressure could cause the chamber housing the balloon to implode, causing damage to the device. Also, access to tie off the balloon is cumbersome in the disclosed device, requiring opening and reaching through a door into the confines of an enclosure. Furthermore, the hinged access taught by the patent forces a balloon to fold or bend at the neck when removed from the inflation chamber. This bending results in uneven stretching of the balloon's neck material, and may cause shifting of the contents of a stuffed balloon. Also, a folded or bent balloon neck is more difficult to seal because rotation of the balloon is impaired.

SUMMARY OF THE INVENTION

The present invention provides an apparatus and method for inserting objects into balloons. An exemplary apparatus has a housing providing a balloon inflation chamber and a chamber containing an air blower to provide pressurized air. (In the context of this invention, a gage pressure reference is used; that is, room pressure is zero or neutral. Pressure above room pressure is positive, and pressure below room pressure is regarded to be vacuum or negative pressure). The balloon inflation chamber is preferably a transparent cylinder to allow virtually unobstructed visibility of an inflating balloon, and has a diameter that is typically slightly larger than a diameter of an inflated balloon. While a blower is preferred for balloon inflation, other sources, including gases compressed into tanks, serve equally well.

A lid is provided to cover and seal the top of the balloon chamber. An exemplary lid carries balloon orifice access structure with a substantially air-tight balloon orifice access tunnel having a removable cap, and includes a balloon orifice expansion mechanism to hold a balloon in position to be inflated. The access tunnel provides sealable access to the interior of an inflated balloon. While the access tunnel of the exemplary embodiment is substantially round in cross section, other shapes, including rectangular, are workable.

The lid may be supported by one or more columns arranged to telescopically extend from the housing. Other suspension systems are within contemplation, including multi-bar, hinged linkages. A preferred lid suspension system provides for vertical translation of the lid without excessive rotation of the lid which would allow the balloon neck to fold or kink. Spring loaded plungers may advantageously interface with detentes located in telescopic columns to control lid elevation above the balloon chamber. Alternatively, one-way sliding releasable stops, ratcheting mechanisms, rotatable cam actuators, screw actuated plungers, or any other temporary securing mechanism may be utilized for supporting the lid at a desired elevation.

The lid of the illustrated embodiment rests on top of a gasket interface with the balloon chamber during balloon inflation. Convenient elevations for lid suspension include a balloon installation elevation and a balloon tie-off elevation. At the balloon tie-off elevation, the balloon preferably hangs suspended substantially vertically from the balloon orifice expansion mechanism. A suspended vertical orientation facilitates closing the balloon neck, eases rotation of the balloon, and also helps to prevent shifting of the balloon's contents.

In the currently preferred embodiment, two telescopic columns support the lid and also serve as ducting between the two chambers to inflate a balloon with air. The illustrated embodiment has rigid ducting elements with a separable interface to allow telescopic actuation and to provide support for the lid at different elevations. Of course, a separating, sealable joint in the ducting structures is not necessary for the implementation of this invention. Other methods providing for air transport are also effective. For example, a length of flexible hose may be utilized instead of providing a separating joint. However, the present embodiment provides simplified assembly, and any air leakages inherent in the ducting elements is inconsequential.

The balloon orifice expansion mechanism currently preferred has multiple gripping elements with fingers disposed to move between a first position in which the fingers are bunched together generally near the centerline of the balloon orifice access tunnel for receiving a balloon orifice, and a second position in which the elements are spaced apart to expand the balloon orifice into contact with a transverse sealing gasket surface. A rotatable mechanism with cam-like arcuate slots is provided for selectively causing the gripping elements to move between the first and second positions. It is currently thought that only one size of balloon access opening (approximately the largest that currently available balloons will accommodate) is of significant commercial interest.

The illustrated embodiment has an electricity powered air blower to push air through ducting elements and into the balloon access tunnel. A one-way valve, illustrated as a ball valve, seals the termination of the duct system at the balloon access tunnel, and prevents air from reversing course. The tunnel is sealed at one end to the lid and has a removable cap disposed at the other end to provide a substantially air-tight seal. When a balloon is installed and the cap is sealed to the tunnel, air blown by the blower into the tunnel inflates the balloon. As the balloon inflates, it displaces air from the balloon inflation chamber. This displaced air flexes the resilient lid from a sealing position over the balloon chamber and exits to the room. The lid essentially acts like a one-way valve to accommodate escape of displaced air.

A method of using the apparatus follows the steps of: raising a lid of the balloon inflating apparatus substantially vertically to a balloon installation position, installing a deflated balloon having an orifice onto an orifice expansion mechanism, lowering the lid to form a seal with an opening of a balloon inflation chamber, inflating the balloon sufficiently to receive the object, keeping the lid in sealed relation to the balloon inflation chamber while removing the cap from the balloon orifice access tunnel, inserting the object through the balloon orifice access tunnel into the balloon, replacing the cap, breaking the seal between the lid and the chamber, raising the lid to a balloon removal position wherein the balloon is suspended substantially vertically from the orifice expansion mechanism, and finally, tieing-off the balloon. The balloon may be inflated either by blowing air into the orifice access tunnel, or in a modified embodiment, by applying a vacuum external to the balloon and inside the balloon inflation chamber.

BRIEF DESCRIPTION OF THE DRAWINGS

In the drawings, which illustrate what is currently regarded as the best mode for carrying out the invention.

DETAILED DESCRIPTION OF THE ILLUSTRATED EMBODIMENT

Figure 1:
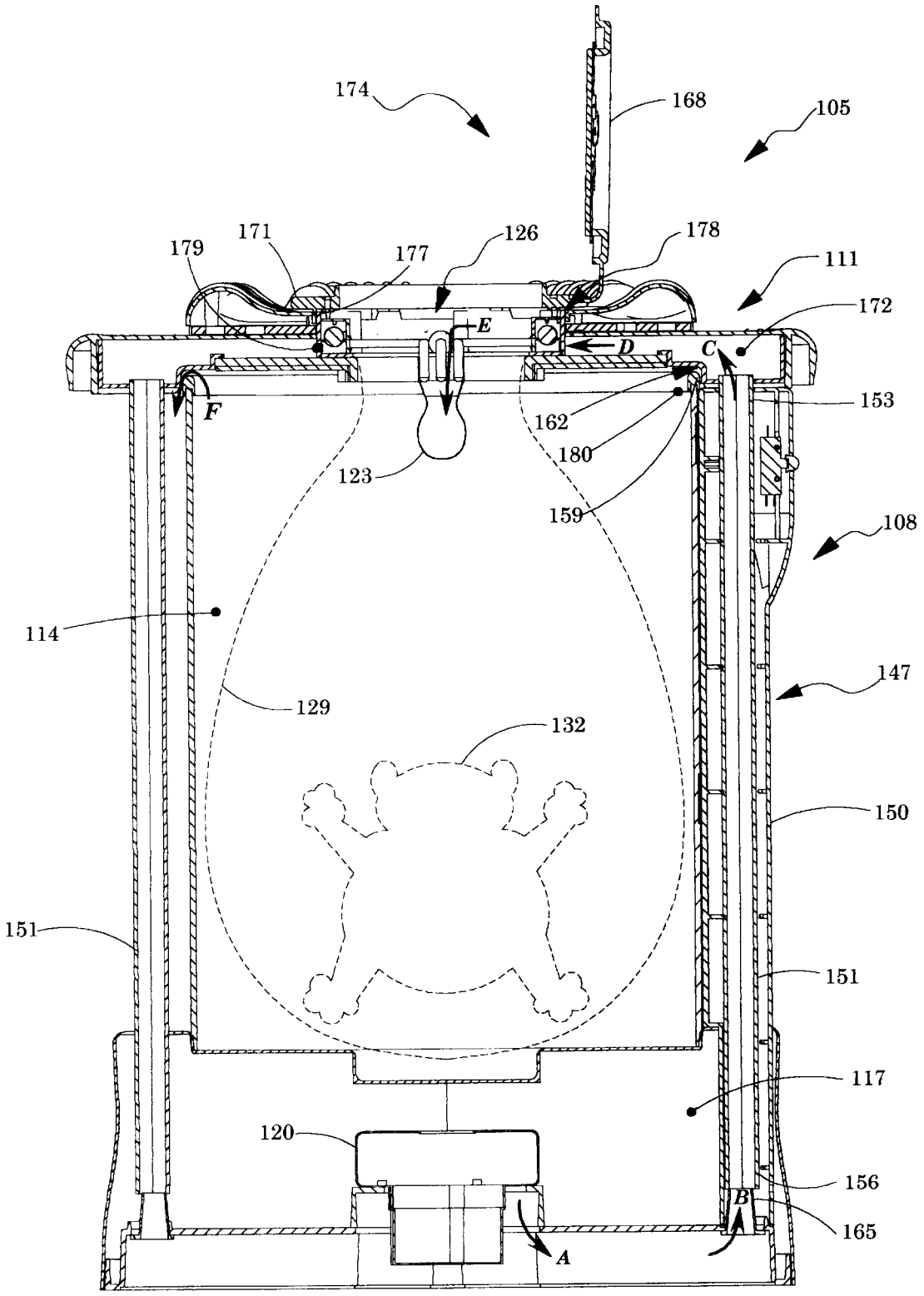
FIG. 1 is an elevation view, substantially in cross-section of an exemplary device constructed according to principles of this invention, but with one vertical lid support column not shown for clarity, and with top of the device displaced slightly in the vertical direction.

One exemplary embodiment of the invention is shown in FIGS. 1–4 wherein like parts are designated with like numerals throughout. FIG. 1 shows an apparatus, generally indicated as 105, for inserting an object into a balloon. Apparatus 105 is designed to operate in a generally vertical orientation as shown. In this embodiment, the device comprises a unitary structure 108 having a lid 111, a balloon chamber 114, and an air source chamber 117 housing a motorized blower 120. A deflated balloon 123 is illustrated in position for inflation and is stretched by balloon orifice stretching mechanism 126. An inflated balloon 129 (phantom) is illustrated in position to receive a gift 132.

The illustrated embodiment is provided with two vertical supports indicated generally as 147, disposed on opposite sides of balloon chamber 114 and providing adjustable elevation of lid 111. Vertical support 147 is a telescopic structure comprising support housing 150 and internal conduit structure 151 (for clarity, one support 147 is illustrated without support housing 150). Conduit structure 151 is sealingly attached on a first end 153 to lid 111, with a second end 156 free to move in a vertical direction within housing 150.

Arrows A–E illustrate a path taken by air from the blower 120 to inflate the balloon 129. As illustrated, the lid 111 is displaced vertically from an actual balloon inflation position where balloon chamber seal 159 sealingly interfaces with lid seal structure 162. Additionally, in an assembled inflation position, second end 156 of conduit structure 151 engages with plenum adapter 165, and cap 168 would be in a closed position (not illustrated) thereby providing a seal with cap base 171. Vertical conduit structure 151 is in open communication with lid conduit 172. Balloon access tunnel structure 174 comprising cap 168, base 171, and access cylinder 177, in harmony with lid 111 continues a pressure resistant conduit path for balloon inflation. Check valve 178 (between arrows D and E) prevents air from escaping the inflated balloon 129 by way of air supply holes 179 through access cylinder 177.

Arrow F illustrates the path taken by air displaced from balloon chamber 114 during balloon inflation. As the balloon 129 inflates, air inflating the balloon displaces an equivalent volume which must be removed from the balloon chamber 114. Lid 111 is flexible enough to displace, particularly mid circumference between vertical supports 150, allowing air to pass between chamber seal 159 and lid sealing structure 162. A small increase in gage pressure in the chamber distorts resilient lid 111 sufficiently to separate the sealing interface 180 between seal 159 and corresponding seal structure 162. As pressure equalizes, the lid reseals the balloon chamber 114. A drop in gage pressure internal the balloon chamber increases seal contact at the interface 180 and prevents air flow across the interface 180. The lid 111 therefore performs the function of a pressure relief, one-way valve. Of course, a dedicated pressure relief or one-way valve could also perform this function, but unnecessarily would increase part count and add complexity to the apparatus.

Figure 2:
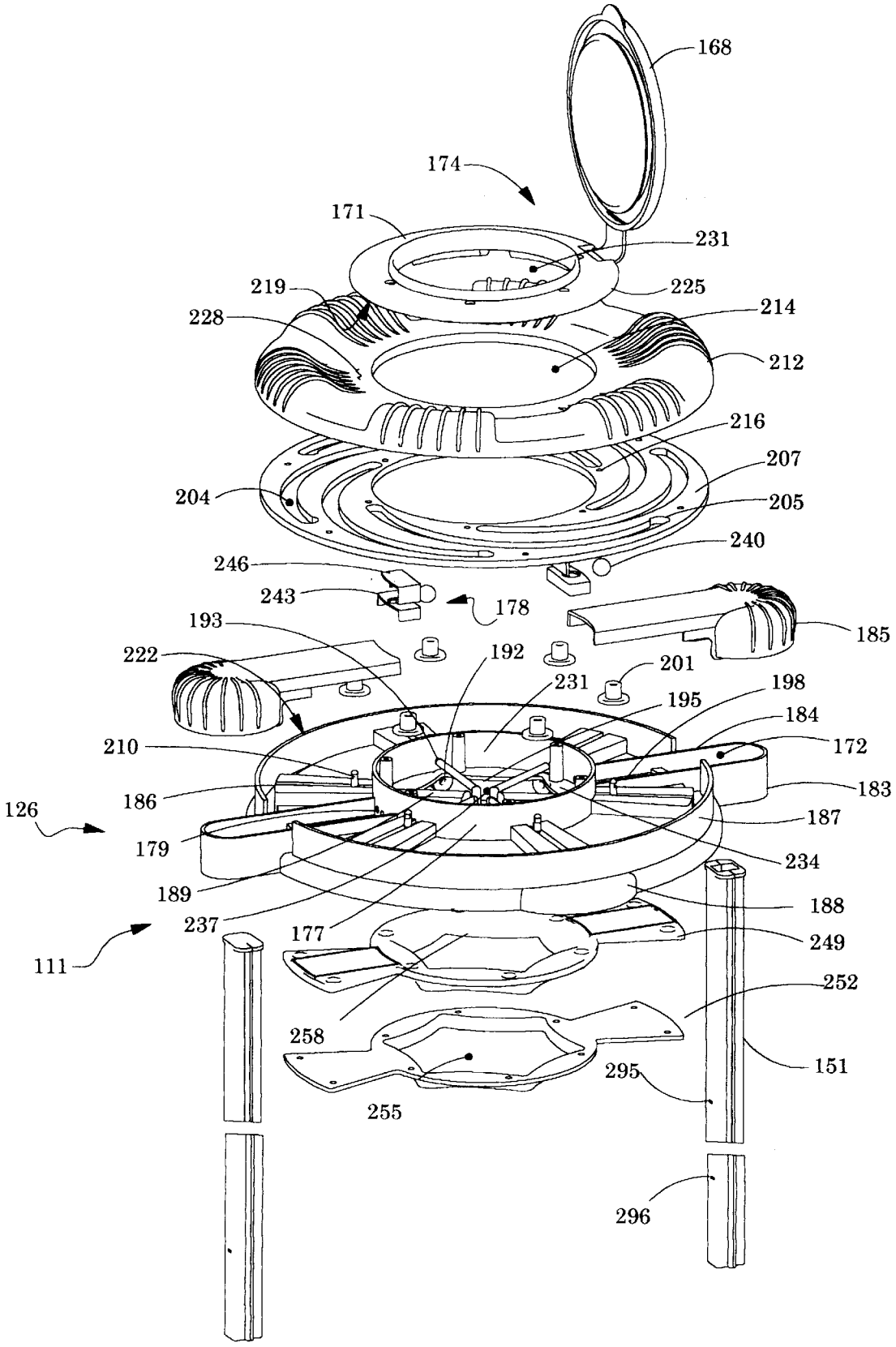
FIG. 2 is an exploded view in perspective, of the top part of the device of FIG. 1, showing the functional arrangement of elements comprising the balloon expansion mechanism, access port, and certain air ducting elements.

FIG. 2 illustrates in more detail the elements comprising the lid 111, balloon access structure 174, and balloon orifice stretching mechanism 126. Lid 111 comprises lid housing 183 having two radially oriented channels 184, each with an aperture (not shown) for receiving conduit structure 151 in a sealed, flow-through relationship. Channel 184 and structure comprising handle cap 185 cooperatively form lid conduit 172. Access cylinder 177 is formed as a cylindrical structure integral to housing 183. Spaced from access cylinder 177, in an outwardly radial direction, is lid housing cylinder 187. Circumferentially spaced about the perimeter of housing 183, approximately midway between conduit structures 151, are lifting handles 188. Lifting handles 188 not only facilitate raising the lid 111, but also conveniently break the seal between gasket 159 and lid sealing structure 162.

Lid housing 183 has molded-in guide structures 186 disposed in a radial orientation and spaced about the circumference of lid housing 183 to guidingly receive retractor arms 189. In the illustrated embodiment, six retractor arms 189 are provided. Grommets 192 fit into pass-through holes 193 in access cylinder 177 and provide a sliding seal interface with retractor arms 189. Each retractor arm 189 has a downward pointing finger 195 to retract a balloon orifice, and an upward pointing hook end 198. Each hook end 198 receives a slider bearing 201 which in turn interfaces with a corresponding cam slot 204 in cam 207. A detente 205 in cam slot 204 provides a receiving location for bearing 201 corresponding to a balloon expanded configuration. Slider bearing 201 assembles on hook 198 by a snap-on fit of structure internal to bearing 201 which indexes into notch 210 on a distal end of hook 198. Bearing 201 may then easily rotate about hook 198.

In an assembled position, cam 207 fits between access cylinder 177 and housing cylinder 187 and rides on top of guide structure 186 and handle caps 185. Rotating actuator 213 sits on top of cam 207 and receives access cylinder 177 through an access port 214. Protruding legs from actuator 213 (not shown) interface with multiple spaced apart holes 216 in cam 207, and cause cam 207 to move in response to rotation of actuator 213. Actuator 213 is illustrated as a manually activated device, but could also be provided with an automating mechanism. Cap base 171 has a bottom seal surface 219 assembling into sealing relation with access cylinder rim 222. Protruding flange 225 of cap base 177 overlaps surface 228 of actuator 213, thereby entrapping actuator 213 and cam 207 between housing 183 and cap base 171. The cap base 171 is secured to housing 183 by threaded fasteners (not shown). Cap 168 is retained to the cap base 171 by a flexible hinge 231 which allows cap 168 to move from a first, closed, position, to a second, open, position, and prevents accidental loss of cap 168.

An air-tight access chamber 231 is created by cap 168, base 171, access cylinder 177, check valve 178, and housing floor 234, having an opening 237 through which fingers 195 of retractor arms 189 extend. The check valve, designated generally 178, comprising check ball 240, valve housing base 243 and valve cap 246, is disposed inboard access cylinder 177 as illustrated. The physical location of valve 178 is not critical to the function of the device. It is conceivable that valve 178 could even be eliminated if alternate valving were provided, perhaps by such structure as blower 120. In the illustrated embodiment, valve housing base 243 is adhesively bonded to access cylinder 177 and floor 234 to create an air-tight seal. Air supply holes 179 port pressurized air from lid conduit 172 into valve housing base 243. Check valve 178 is opened by air pressure from blower 120 (FIG. 1) which raises ball 240 from a seated position on base 243. Check ball 240 is illustrated as being caged between housing base 243 and valve cap 246 and is constructed and arranged so that disengaging supply air pressure automatically reseats check ball 240 on base 243, thereby sealing chamber 231 from loss of air through air holes 179 when blower 120 is turned off.

Opening 237 provides sealed access to inflate a balloon 123 (FIG. 1). A thermoplastic rubber sealing gasket 249 (FIG. 2) is retained in sealing arrangement to floor 234 by plastic retainer 252 using threaded fasteners (not shown). A balloon orifice is stretched by fingers 195 of retractor arms 189 to fill the opening 255. The parts of the balloon orifice spanning between fingers 195 rest in transverse sealing relation against arcuate panels 258 of gasket 249.

Figure 3:
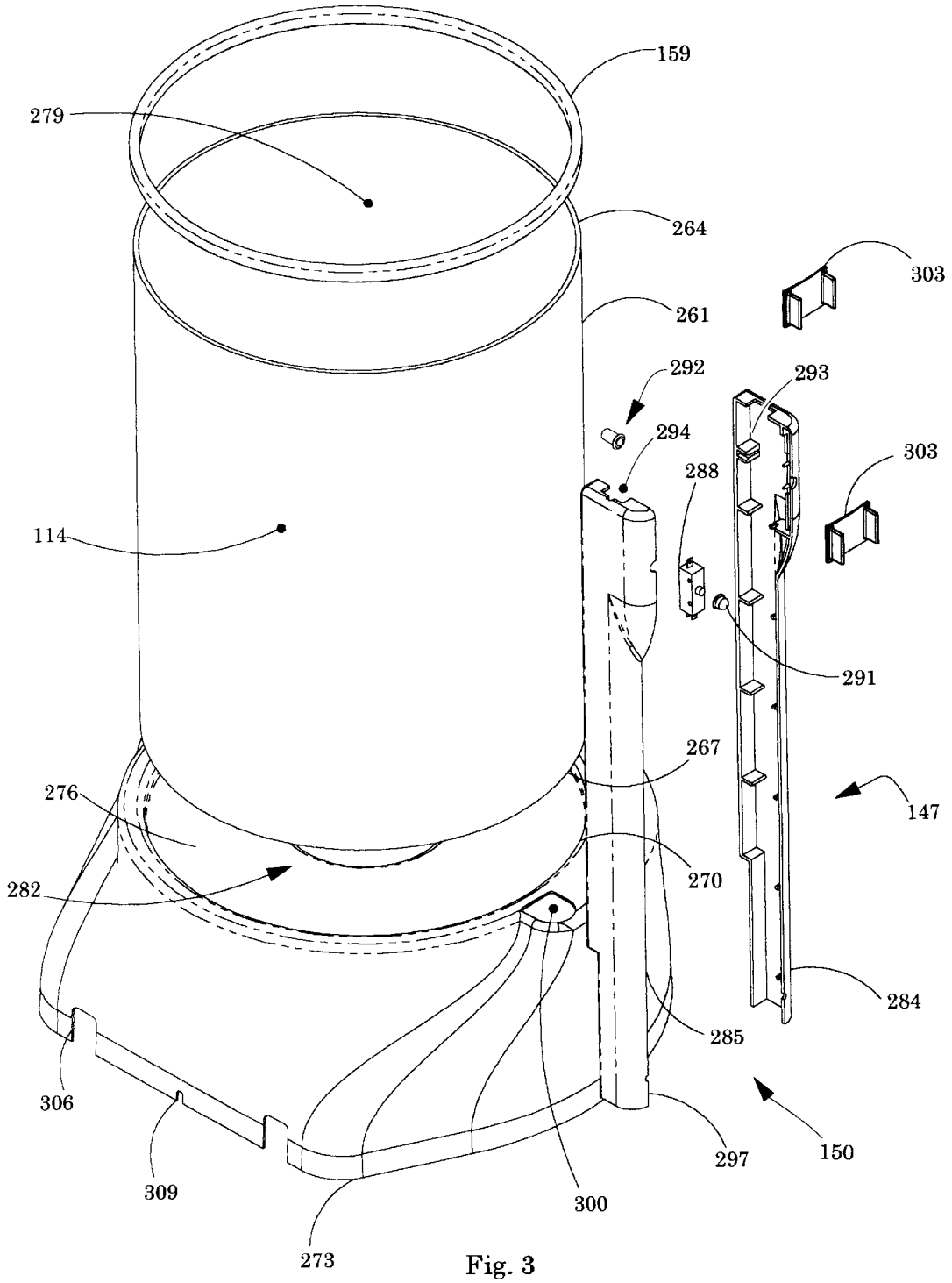
FIG. 3 is an exploded view in perspective of elements comprising a balloon chamber and lid support structure for the device of FIG. 1.

FIG. 3 presents details of construction of the balloon chamber 114 and vertical supports 147. Balloon chamber 114 comprises a transparent cylinder 261 which is formed by rolling a sheet of material and gluing a mitered axial scarf joint (not shown). The scarf joint is located behind one of vertical supports 147 in an assembled apparatus to provide maximally unobstructed visibility into chamber 114. Gasket 159 is installed on a first end 264 of cylinder 261 for sealing interface with lid 111. Alternatively, the gasket 159 may be affixed to lid 111 to removably seat on first end 264 of cylinder 261. A second end 267 of cylinder 261 is adhesively bonded to receiving cylinder 270 of base housing 273. The floor 276 of base housing 273 closes second end of cylinder 261, thereby creating an air tight chamber having an access opening 279. Floor 276 has transverse details 282 to provide structural reinforcement.

As illustrated in FIG. 3, vertical supports 147 for lid 111 may be formed in part by vertical support housings 150. Housings 150 may be formed from left and right clamshell structures 284 and 285. Clamshells 284 and 285 are assembled in a snap-fit engagement, and house switch 288 and decorative switch button cover 291. Switch 288 energizes blower 120 to inflate a balloon and could be located at any convenient location and could comprise any type of actuating switch. Opening 294 receives conduit structure 151 in a sliding relation. A spring and plunger assembly 292, also housed within clamshells 284 and 285 (e.g. in retaining structure 293), is configured and arranged to interface with upper and lower detentes 295 and 296 (see FIG. 2) formed in conduit structure 151, to provide support for the lid 111 at various predetermined elevations above rim 264. Vertical support lower end 297 assembles through port 300 of base housing 273. Each vertical support 147 is structurally supported by two vertical support clips 303 which are adhesively fastened to cylinder 261 and secured to vertical supports 147 by threaded fasteners (not shown). Finally, base housing 273 has notches 306 and 309 to accommodate wheels and an electric cord, respectively.

Figure 4:
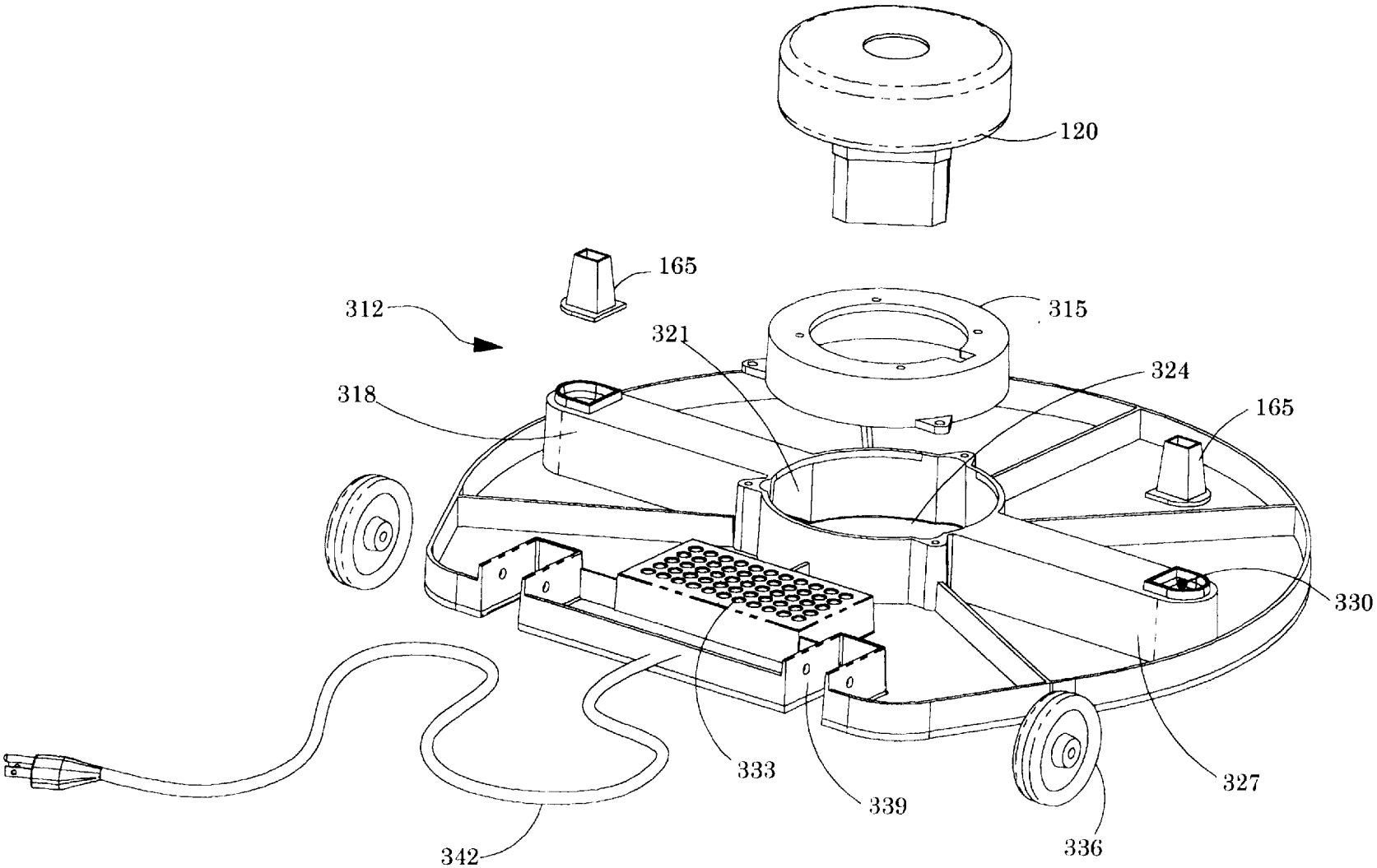
FIG. 4 is an exploded view in perspective of the base of the device of FIG. 1.

Details of bottom plate 312 are illustrated in FIG. 4. Blower motor 120 and motor adapter 315 assemble to plenum structure 318 with threaded fasteners, and form substantially air-tight plenum chamber 321. Bottom plate floor 324 provides a wall of the chamber 321, and with plenum structure 318, creates base conduit 327. Openings 330 in base conduit 327 receive plenum adapters 165 in open communication. Bottom plate wall 333 slidingly interfaces with base housing 273, and is secured thereto with threaded fasteners (not shown). Air inlet vent opening 333 is integrally formed into bottom plate floor 324. A filter may be provided to maintain a clean flow of inflation air. Wheels 336 are assembled into wheel-wells 339 and provide convenient means to transport the apparatus 105. Electric cord 342 provides power for the blower motor 120.

In general, apparatus 105 comprises structural elements formed by injection molding ABS plastic material. Exceptions include conduit elements 151, which are injection molded of a fiberglass-filled rigid PVC sold under the trade name Fiberlock™ for increased stiffness, and base housing 273 which is thermoformed. As mentioned previously, transparent cylinder 261 is also thermoformed. Balloon gasket 249 is injection molded thermoplastic rubber. Plastic materials provide sufficient structural integrity, and offer attractive coloration. Joints between elements and assemblies generally comprise snap-together, interference fits, threaded fasteners, or are adhesively bonded. Other materials and methods of construction are workable.

EXAMPLE OF METHOD OF USE

In use of apparatus 105, a user first raises lid 111 to a balloon installation position where spring loaded plungers interface with upper detentes 295 in conduit structure 151, thereby providing support to maintain the lid 111 in place. A balloon installation position provides convenient access to install a deflated balloon onto fingers 195 of orifice expansion mechanism 126. Prior to installing a balloon, fingers 195 are located bunched together approximately at the center of opening 237. Cap 168 may be opened to provide enhanced visibility of orifice expansion mechanism 126 during balloon installation. A balloon is placed onto the fingers 195 and lid 111 is then lowered to form a seal with opening 279 of balloon chamber 114. Actuator 213 is then rotated to retract fingers 195 and locate slider bearings 201 in cam detentes 205, thereby expanding the balloon orifice and forming a balloon seal with gasket 249. After cap 168 is replaced onto cap base 171, switch button 291 is depressed to energize blower 120 and inflate the balloon. Lid 111 functions as a one-way valve by deflecting to allow air displaced by the inflating balloon to vent from the balloon chamber across a portion of the chamber-to-lid seal. When the balloon is sufficiently inflated to receive the object, switch button 291 is released, and lid 111 forms a seal to chamber opening 279, thereby preventing air which might deflate the balloon form entering the balloon chamber. With lid 111 in sealed relation to chamber 114, the cap 168 may be removed and the balloon will remain in a substantially inflated position. The object is inserted into the balloon, and then cap 168 is replaced. In the vent that the balloon has deflated too much due to an inadvertent air leak, switch button 291 may again be pressed to reinflate the balloon as desired. With the balloon inflated to the desired condition, cap 168 reinstalled and sealed, and switch 291 in the off position, the seal between lid 111 and chamber 114 may be broken by lifting at one or both of handles 188. Continued lifting of the handles 188, or cap handles 185, raises lid 111 past the balloon installation position, and to a balloon removal position where the spring loaded plungers interface with lower detentes 296 in conduit structure 151. In this balloon removal position, the balloon is substantially free of the chamber 114, and is suspended vertically from orifice expansion mechanism 126. The balloon neck may then be squeezed, and the balloon may be rotated to facilitate tying-off the balloon. After the balloon neck is at least temporarily sealed, actuator 213 is counter-rotated to extend fingers 195 to approximately the center of opening 237, and the balloon is removed form expansion mechanism 126. A new, deflated, balloon may be installed either with the lid 111 in the elevated balloon removal position, or after lowering the lid 111 to a lower balloon installation position. The balloon inflation and object loading processes are then repeated for the next balloon.

The invention is described with reference to a particular embodiment illustrated in the appended figures. While the illustrated embodiment is currently considered the best mode for carrying out the invention, it is intended to be illustrative only, not restrictive. The scope of the invention is properly encompassed by the appended claims.

What is claimed is:

1. Apparatus for inserting an object into a balloon, comprising:

a balloon chamber having a size sufficient to accommodate an inflated balloon, said chamber having an opening through which an inflated balloon may pass;

a lid disposable over said chamber opening for forming a substantially air-tight seal with the balloon chamber, said lid having means to access the balloon orifice;

a positive pressure air source for inflating the balloon in said chamber, said air source being in communication with said balloon orifice access means;

said lid further has means to expand and maintain balloon orifice in an expanded state and in contact with a sealing surface including:

a plurality of gripping elements disposed to move between a first position in which said elements are bunched together generally near the center of said balloon orifice access means for receiving a balloon orifice, and a second position in which said elements are spaced apart to expand said balloon orifice into contact with said sealing surface, and means for selectively causing said gripping elements to move between said first and second positions; wherein said balloon orifice access means comprises a tunnel structure in sealing relation on a first end to said lid and having a removable cap to seal a second end, thereby maintaining positive pressure inside said balloon access means while inflating said balloon.

2. An apparatus according to claim 1, wherein;

said lid is movably supported by lid support structure between a first elevation position wherein said substantially air-tight seal with said balloon chamber is formed, and a second elevation position providing access to tie off the balloon, and said lid support structure comprises air ducting structure for inflating a balloon.

3. An apparatus according to claim 2 wherein said lid support structure comprises air ducting structure configured and arranged in a telescopic relationship with a support structure.

4. An apparatus according to claim 1, wherein;

said lid is movably supported by lid support structure between a first elevation position wherein said substantially air-tight seal with said balloon chamber is formed, and a second elevation position providing access to tie off the balloon, and said second elevation position is reached by a primarily vertical translation of said lid.

5. An apparatus according to claim 1, wherein said balloon chamber comprises a transparent cylinder.

6. An apparatus according to claim 5, wherein said transparent cylinder has a diameter in approximate correspondence with a diameter of an inflated balloon.

7. An apparatus according to claim 1, further comprising a valve located within the path of air delivery from said air source to said balloon orifice;

said valve being constructed and arranged to allow air flow directed toward said balloon orifice, and to prevent air flow away from said balloon orifice.

8. Apparatus for inserting an object into a balloon, comprising:

a balloon chamber having a size sufficient to accommodate an inflated balloon, said balloon chamber comprising a substantially transparent structure providing substantially unobstructed visibility to observe an inflating balloon and having an opening through which an inflated balloon may pass;

a lid disposable over said chamber of opening for forming a substantially air-tight seal with the balloon chamber, said lid having means to access a balloon orifice;

means to raise said lid in a substantially vertical direction to a balloon tie-off position where the balloon is suspended in a substantially vertical orientation from a balloon orifice expansion mechanism and the balloon neck is substantially free of bending;

means to support said lid in said tie-off position; and means to inflate a balloon inside said balloon chamber.

9. An apparatus according to claim 8, wherein said balloon orifice access means further comprises means to expand said balloon orifice and to maintain said balloon orifice in an expanded inflation position.

10. An apparatus according to claim 9, wherein said balloon orifice expansion means comprises:

a plurality of gripping elements disposed to move between a first position in which said elements are bunched together generally near the center of said balloon orifice access means for receiving a balloon orifice, and a second position in which said elements are spaced apart to expand said balloon orifice into contact with said sealing surface, and means for selectively causing said gripping elements to move between said first and second positions.

11. An apparatus according to claim 9, wherein said transparent structure comprises a cylinder.

12. An apparatus according to claim 11, wherein said cylinder has a diameter approximately in correspondence switch a diameter of an inflated balloon.

13. An apparatus according to claim 9, wherein said means to raise said lid comprises columns configured in a telescopic arrangement.

14. An apparatus according to claim 13, wherein said columns further provide an air conduit for transporting air.

15. An apparatus according to claim 14, wherein said lid support means comprises:

a spring loaded plunger, and a detente in said column, said detente located and arranged for interface with said plunger to provide support for said lid at a balloon removal elevation.

16. An apparatus according to claim 11, wherein said inflation means comprises air under positive pressure and directed to the balloon orifice.

17. An apparatus according to claim 16, wherein said lid further comprises a one-way valve to allow escape of air displaced by inflating a balloon.

18. A method for inserting an object into a balloon comprising the steps of:

raising a lid of a balloon inflating apparatus substantially vertically to a balloon installation position, wherein said lid carries balloon orifice access structure comprising a substantially air-tight balloon orifice access tunnel having a removable cap, and including a balloon orifice expansion mechanism;

installing a deflated balloon having an orifice onto said orifice expansion mechanism;

lowering said lid to form a seal with an opening of a balloon inflation chamber;

inflating the balloon sufficiently to receive the object;

keeping said lid in sealed relation to said chamber while removing said cap from said orifice access tunnel;

inserting the object through said orifice access tunnel into the balloon;

replacing said cap;

breaking said seal between said lid and said chamber;

raising said lid to a balloon removal position wherein the balloon is suspended substantially vertically from said orifice expansion mechanism; and tieing-off the balloon.

* * * * *